United States Patent [19]

Owen, Jr.

[11] 4,196,742

[45] Apr. 8, 1980

[54] SKI-POLE OR CRUTCH

[76] Inventor: Clure H. Owen, Jr., 61 Birge St., Windsor Locks, Conn. 06096

[21] Appl. No.: 847,081

[22] Filed: Oct. 31, 1977

[51] Int. Cl.[2] ..... A61H 3/02; A45B 3/14; A45B 9/02; A63C 11/22

[52] U.S. Cl. ..... 135/71; 135/66; 135/72; 135/75; 135/78; 280/816; 280/821; 280/822

[58] Field of Search ..... 135/71, 72, 66, 81, 135/77, 82, 84, 75, 78; 280/11.37 B, 11.37 R, 11.37 H, 11.37 L, 11.37 D, 11.37 G, 11.37 F, 11.37 P; 42/52

[56] References Cited

U.S. PATENT DOCUMENTS

| | | | |
|---|---|---|---|
| 879,471 | 2/1908 | Kabureck | 135/84 |
| 1,315,356 | 9/1919 | Willard | 52/84 |
| 1,547,046 | 7/1925 | King | 135/71 |
| 1,613,593 | 1/1927 | Walker | 42/52 |
| 2,060,859 | 11/1936 | Flynt | 52/84 |
| 2,192,766 | 3/1940 | Cedarstrom | 135/71 |
| 2,568,654 | 9/1951 | Neptune | 135/72 |
| 2,799,287 | 7/1957 | Wagner | 135/77 |
| 2,817,348 | 12/1957 | Holliday, Jr. | 135/71 |
| 2,910,995 | 11/1959 | Jacuzzi | 135/77 |
| 3,738,674 | 6/1973 | Paul | 135/66 X |
| 3,741,226 | 6/1973 | Urban | 135/84 |
| 3,948,535 | 4/1976 | Negi | 280/11.37 B |

FOREIGN PATENT DOCUMENTS

| | | | |
|---|---|---|---|
| 128895 | 2/1932 | Austria | 280/11.37 P |
| 1272193 | 7/1968 | Fed. Rep. of Germany | 280/11.37 P |

*Primary Examiner*—Nile C. Byers, Jr.
*Assistant Examiner*—Conrad Berman

[57] ABSTRACT

A ski-pole or crutch is provided with a forearm yoke at its upper end and a pistol grip spaced below it. Both the yoke and pistol grip face rearward so that when the pistol grip is held in one hand the yoke can be swung into and out of locking engagement with the upper side of the forearm simply by bending the wrist, thereby providing greater maneuverability of the pole and support of the arm when needed for balance, support of the body and steering by planting the pole or dragging it.

3 Claims, 15 Drawing Figures

32
38
40
36
34
24
B
22
28
27
30
58
62
60
64
26
20
50
C 33
24
50
48
42
82

55
17
18
66
B
20
28
A
0°
10°
20°
D
27

30
C
22
68
120
118
20
46
21
D
42
36
34
33
32
64
26
58
A

50

42
46
48
22

54
52
56
56
52

SKI-POLE OR CRUTCH

BACKGROUND OF THE INVENTION

Skiers are normally provided with only one means of support to help maneuver their skis—the standard ski-pole. For the sake of lightness, it is usually unadjustable and single purpose in nature. The total weight of a pole is usually the prime selling point, not safety, versatility, or tip forces and velocities. This is caused by an over-simplified translation of the racer's edge to skiers who rarely worry about saving a few hundredths of a second in a race. While weight near the tip of a ski-pole has large effects on swing weight or the ability to flick the pole to a new position, weight near the handle has very little effect. A pound in the handle has little effect, while an ounce at the tip is noticeable in sluggish performance.

The standard ski-pole is an excellent device for propelling in a forward direction as in nordic or cross country skiing. In downhill skiing it provides little supporting force, balancing force, or steering force when held in the normal manner. There are five ways to increase these forces known to be in use. First, is to place both poles between the legs and drag them while sitting lightly near the mid-point—a common practice in cross country skiing. The second way is to use a two-hand grip and to lever both poles at the side of the hip as a mountaineer would use an ice ax to glissade. Originally this was done with a single pole about eight feet long. The third way is to put the arms through the safety straps and grip the poles with a partial grip just below the normal grips. This is moderately effective, but seldom used. The fourth way is very effective, but is normally reserved for the handicapped, such as a one-legged skier. The device used is known as a crutch ski and is comprised of a forearm crutch with a small ski and cleats attached to the bottom. An example of this device is found in U.S. Pat. No. 3,738,674 issued to Edward A. Paul on June 12, 1973. The resulting tip swing weight is very heavy, but is of minor consequence to a non-racing amputee. The handle and yoke point forward in such a way that if the tip is snagged, the handle pulls out of the hand and recovery is difficult. The fifth way uses a standard ski-pole gripped in the normal way. The forearm is pointed toward the ground and the tip and basket are dragged with as much downward pressure as the hand can apply. It is used by most skiers when skiing near the limits of speed, terrain, or skill. In the case of downhill racers, it is often the main means of attitude control since the skis may be out of contact with the surface much of the time. The main effect is in pitch and yaw.

SUMMARY OF THE INVENTION

This invention relates to ski-poles, crutches and the like. One object of the invention is to provide a skier or the like with increased mobility and safety. Another object is to provide a ski-pole with a mount for various devices.

The present invention uses a rear-facing yoke and inclined pistol-grip handle so that when the tip is snagged, the yoke unlocks or swings forward away from the forearm. The pistol-grip is forced up and into the hand so that there is little tendency to lose a grip. Since the present invention is intended for all types of skiing by able-bodied skiers, mainly various types of free style skiing, the impacts on the tip of the ski-pole can be large and at any angle. The upward or axial force could easily exceed the strength of a healthy arm. However, since the elbow bends back and the yoke unlocks forward, a tip overload results in a safe toggling action from forearm mode to cane mode.

BRIEF DESCRIPTION OF DRAWINGS

In the drawings I have shown in detail a preferred embodiment of the invention, but it will be understood that various changes may be made from the construction shown, and that the drawings are not to be construed as defining or limiting the scope of the invention, the claims forming a part of this specification being relied upon for that purpose.

Other objects and advantages of the invention will become apparent in the following description of the accompanying drawings wherein.

DESCRIPTION OF THE PREFERRED EMBODIMENT

Figures 1, 2, 3, 4, 5, 6, 7, 8:
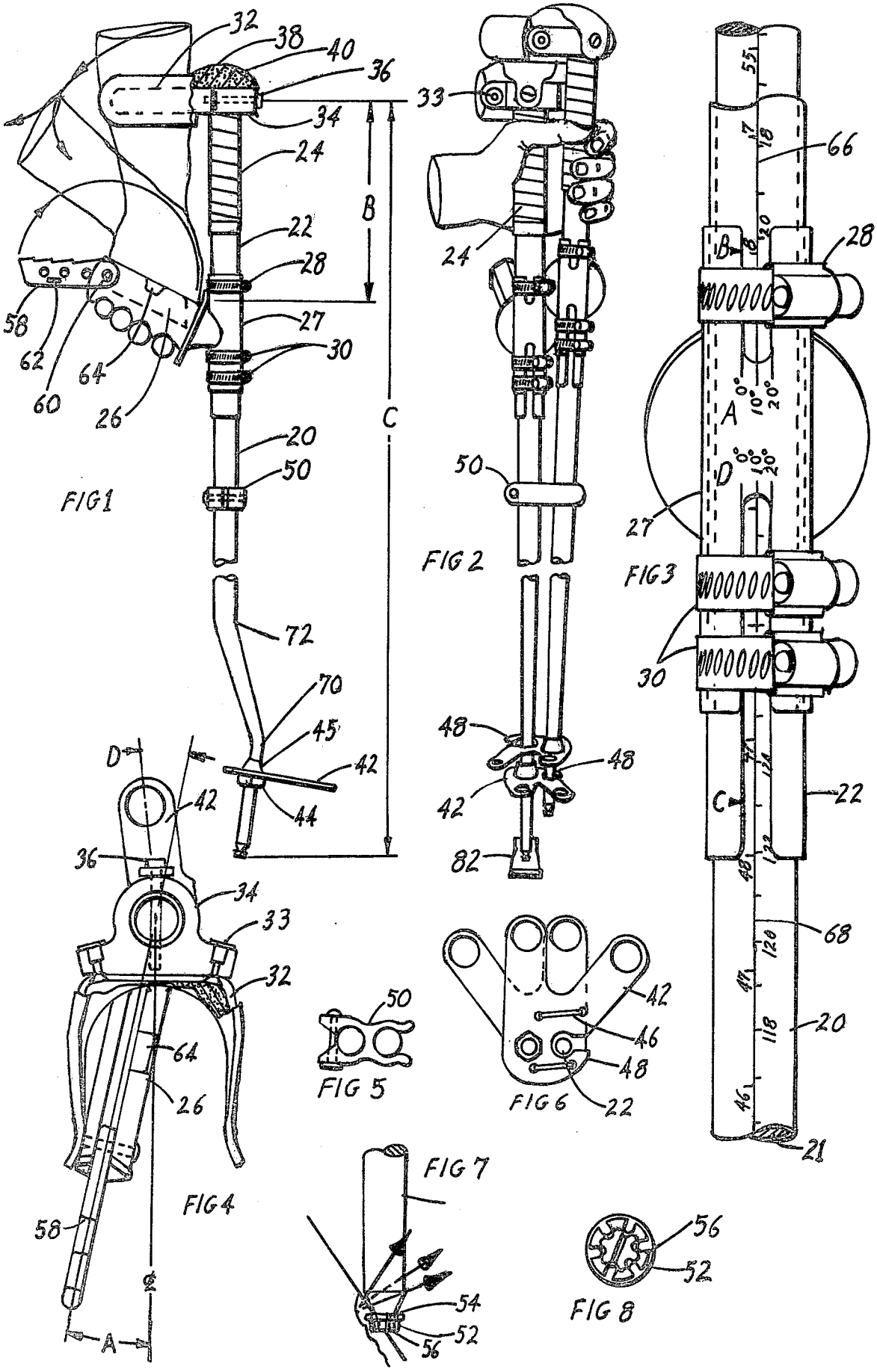
FIG. 1 is a side elevation of a ski-pole with an arm in cane and forearm mode.
FIG. 2 is a front elevation of two ski-pole crutches clipped together with a hand shown in standard mode.
FIG. 3 is a fragmentary front elevation of the pistol grip area showing a typical adjustment of the scales for left hand pole.
FIG. 4 is a top fragmentary view of a left hand ski-pole.
FIG. 5 is a partial cross sectional view of the interconnecting clip.
FIG. 6 is a bottom view of two ski-poles clipped together.
FIG. 7 is a fragmentary view of the lower portion of the ski-pole.
FIG. 8 is a bottom view of the ice tip.

Referring to the accompanying drawings in detail, FIG. 1–8 show a ski-pole used singularly or in pairs in various modes. A shaft 20 is inserted to various depths into the telescoping tube 22 to provide adjustable overall length. The telescoping tube 22 and the pistol grip tube 27 are slotted to allow for contraction when clamped by band clamps 28 and 30. The slots as shown in FIG. 3 may also provide windows for adjustment scales. Four scales are provided for fitting the poles to different users and uses. The upper scale 66 is used to set the yoke 32 to pistol grip 26 angle A and distance B. An angle of about ten degrees is needed to compensate for pole and arm deflection under hard braking in downhill skiing. If set incorrectly, hard stearing and/or wobbling will occur. A lower scale 68 is provided to set the overall length C of the poles and the angle D of the basket 42 to the pistol grip 26.

Use as a standard ski-pole is provided for by a hand grip 24. Use as a cane, as shown in FIG. 1, is provided for by a pistol grip 26 that is adjustably clamped to the telescoping tube 22 by an upper band clamp 28 at the top of the pistol grip tube 27. Further clamping of the pistol grip 26 is provided by one or more lower band clamps 30 that also clamp the telescoping tube 22 to the shaft 20. One lower band clamp 30 will provide sufficient clamping; additional lower band clamps 30 will provide a margin of safety to this critical area.

Use as a forearm ski-pole as shown in FIG. 1 is provided for by grasping the pistol grip 26 and swinging the forearm up into the yoke 32. The yoke 32 is attached to the yoke shock mount 34 by bolts 33. The yoke shock mount 34 is press fitted onto the telescoping tube 22 and pinned by the cross bolt 36. The yoke 32 and yoke shock mount 34 are covered by a leather cover 38 and foam rubber padding 40 to prevent injuries and provide comfort. A basket 42 is clamped by an elastic stop nut 44 to a serrated collar 45 on the shaft 22. Metal staples 46 are fastened to the basket 42 to prevent ski edges from cutting the basket 42. For two pole-one hand operation, the baskets 42 are provided with hooks 48 to engage the mating shaft 20 as shown in FIGS. 2 and 6. A hard rubber clip 50 secures the poles together near the middle of the shafts 20.

Since the poles may be used on ice in a dragging and sweeping direction as well as the normal pushing direction, a multi-point tip 52 is provided. The tip 52, as shown in FIGS. 7 and 8, has upward cutting edges 54 and side cutting edges 56 and may have the form of a grooved hex washer head screw. Chips or chunks of ice are expelled from an area just ahead of the tip at considerable velocity, as illustrated by the arrows in FIG. 7. This can produce vibration or chatter. While not critical, the vibration can be lessened by filling the upper half of the shaft 20 with a wooden dowel 21 that is held in place by a high hysteresis glue. The wooden dowel 21 also increases the strength and reliability of the pole.

When the poles are to be used on a very steep icy slope, an ice arrest pick 58 may be fitted to the pistol grip 26 in a jack knife manner by a pivot bolt 60. A large extractor groove 62 and extractor groove slot 64 are provided for use by a gloved hand. During a fall on ice or when traversing on steep icy slopes, as for example on the famous headwall in Tuckerman's Ravine on Mt. Washington, the blade of the arrest pick 58 can be exposed by pivoting it out of grip 26 to the position shown in FIG. 1. The upper edge of pick 58 can then be dragged along the ice with the forearm in the yoke 32, so that the skier can steady himself or slow himself down as he slides on the ice. Furthermore, during a fall on ice, an expert skier can keep his legs and skis below him by dragging the arrest pick on the ice, thereby making it possible to stop his fall completely or even to recover his balance and continue his decent on his skis. The arrest pick is only effective in forearm mode and the user should be protected from ice chip spray by heavy clothes.

The shaft 20 may have two bends 70 and 72 near the basket to incline the tip 52 at a more favorable contact angle and to stiffen the pole in column compression in forearm mode and cane mode. In standard mode the pole has lowered stiffness.

Figure 9:
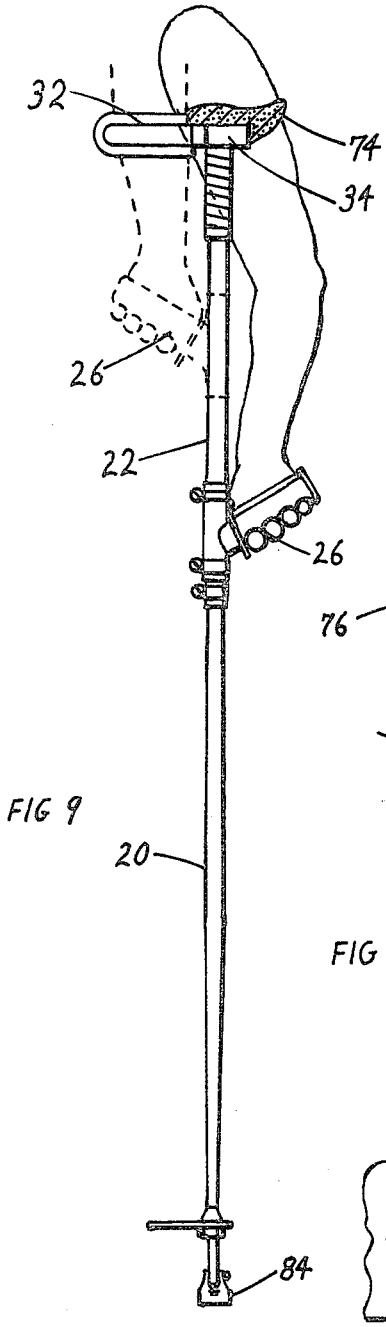
FIG. 9 is a side view of a convertible forearm to shoulder crutch.
Figure 10:
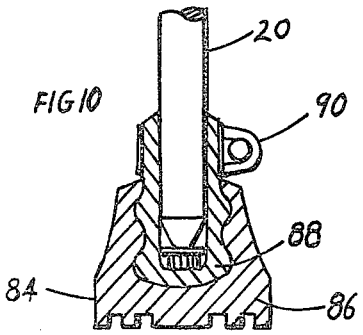
FIG. 10 is a fragmentary view of the lower portion of the ski-pole.

A shoulder crutch is provided for in FIG. 9 by making the telescoping tube 22 substantially longer than is required for a forearm crutch. A shoulder pad extension 74 is added to the yoke shock mount 34 and the pistol grip 26 is moved from the forearm position down to the shoulder crutch position. The longer telescoping tube 22 provides for the greater range of overall length adjustment required for conversion from forearm crutch to shoulder crutch. It is understood that a ski-pole is used for many non-skiing activities such as walking, skating, skate-boarding, unicycling and the like. A crutch tip 84 is, therefore, provided for off-snow use and safe transport. Since the intended use quickly ruins regular crutch tips, a reinforced type as shown in FIG. 10 is preferred. The exterior 86 is the normal soft, high traction elastomer. The interior liner 88 is bonded of a hard elastomer. A band clamp 90 provides adjustable retention in the small area available.

Figure 11:
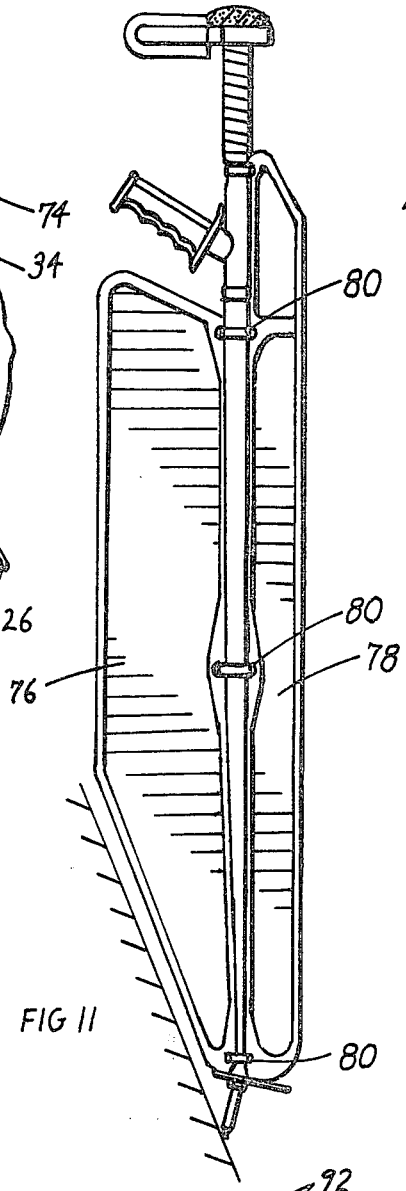
FIG. 11 is a side elevation of a ski-pole winglet.
Figure 12:
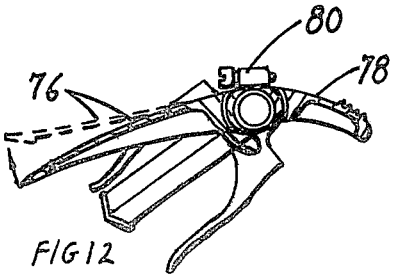
FIG. 12 is a bottom sectional view of the combination shown in FIG. 11.

An aerodynamic control surface or winglet is provided for in FIGS. 11 and 12 by the optional attachment of a trailing flap 76 and/or a leading flap 78 to the shaft 20 by means of several band clamps 80. By changing the angular position of the flaps 76 and 78, the camber, twist, and relative angle of attack can be varied. The actual angle of attack is chosen by arm rotation to vary the lift and drag. A STOL type wing section with a highly cambered or cupped blade is preferred. A rough leading edge helps in low speed control at high angles of attack.

Several pounds of additional mass can be carried around the pistol grip 26 with relatively little loss of performance. If the mass is structurally rigid, such as the gun 82 shown in FIGS. 13 and 14, then it can replace a portion of the shaft 20, telescoping tube 22 and/or pistol grip 26.

Figure 13:
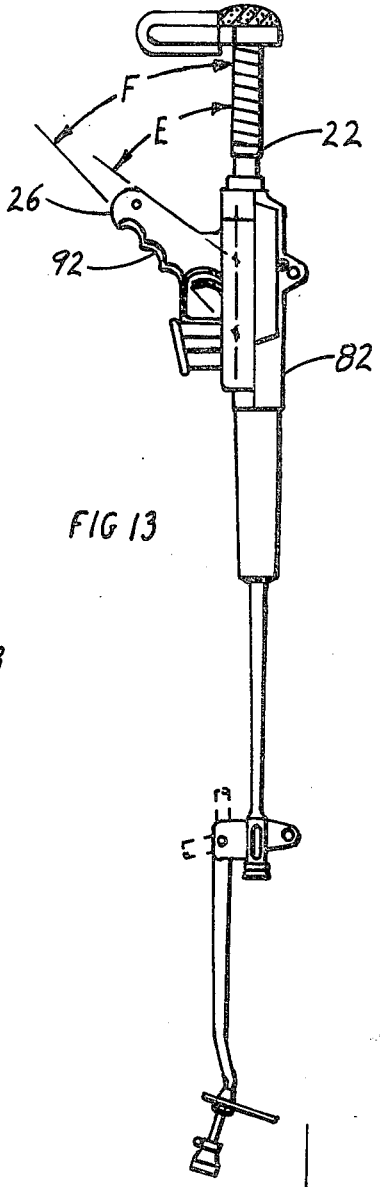
FIG. 13 is a side elevation of a typical combination of a ski-pole with a gun.
Figure 15:
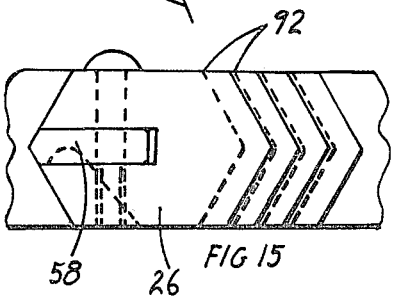
FIG. 15 is a fragmentary end view of the pistol grip.
Figure 14:
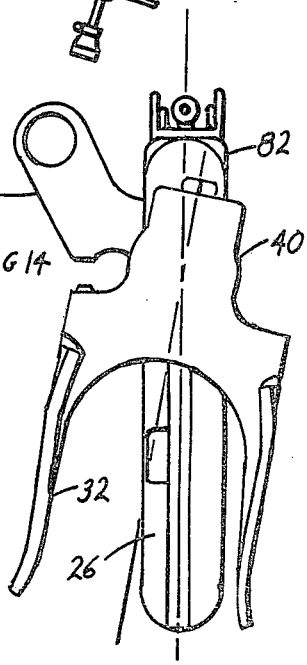
FIG. 14 is a top view of the combination shown in FIG. 13 for right hand operation.

Various shape pistol grips 26 have been used with success. One particular shape has proven best for all-around use. FIGS. 13 and 15 show this shape with deep finger grooves 92. The skier in cane mode should be able to flick the pole laterally without the pole slipping in a gloved hand. The cross section of the grip should interlock with the hand in the same way that a bolt head interlocks with a wrench. An irregular or slightly elongated hexagonal cross section is preferred.

It is important in all applications of the present invention, whether for carrying large masses, such as the gun 82 (FIG. 13) or for using the ice pick 58 (FIGS. 1 and 4), as well as for maneuvering in a more-or-less conventional manner while skiing, that the pistol grip 26 be inclined toward the forearm yoke 32 at an angle which is natural in the forearm mode—i.e. when the forearm of the skier is cradled in the yoke as illustrated in FIG. 1. The pistol grip rear angle E illustrated in FIG. 13 should be fairly steep. More than 60 degrees causes hand fatigue in forearm mode. This fatigue is caused by having to continually force the yoke onto the forearm. An angle less than 45 degrees tends to cause slipping along the grip. An angle of 50–55 degrees is preferred for all around use. The pistol grip front angle F is less critical, with an angle of 40 to 55 degrees preferred.

What is claimed is:

1. A ski-pole or crutch comprising an elongated shaft defining a longitudinal axis, a U-shaped forearm-rest or yoke rigidly mounted adjacent one end of said shaft with the legs of said forearm-rest extending from said shaft transversely of said axis in a rearward direction, said legs being spaced from each other by a distance suitable for cradling the forearm of the user and substantially symmetrical relative to the fore-and-aft plane through said longitudinal axis in said direction, and a pistol-grip handle rigidly mounted on said shaft and extending laterally therefrom generally in said rearward direction, said handle being spaced from said forearm-rest in the direction of the other end of said shaft and inclined toward said forearm-rest at an angle to said shaft, such that when it is gripped by the hand of the user with the thumb adjacent said shaft and in a natural attitude with respect to the forearm, said longitudinal axis of said shaft is disposed substantially parallel to the forearm, said forearm-rest being adapted and arranged to supportingly engage the forearm of the user when his hand is in said natural attitude and to be moved free of said forearm upon bending the wrist in a direction in which the little finger of the hand is nearer the wrist wherein said shaft comprises a tubular shaft member at said one end on which said forearm-rest and said pistol-grip handle are mounted and a lower shaft member telescopically received within said tubular member for adjusting the length of said ski-pole or crutch, said tubular member being split longitudinally adjacent its end into which said lower shaft member telescopes, and said pistol-grip mounting means comprising a sleeve on which said handle is fixed, said sleeve being at least partially split longitudinally and surrounding the split portion of said tubular member, and a clamp for squeezing said sleeve in order to fix said pistol-grip handle on said shaft and simultaneously to fix said lower shaft member with respect to said tubular shaft member.

2. A ski-pole or crutch comprising an elongated shaft defining a longitudinal axis, a U-shaped forearm-rest or yoke rigidly mounted adjacent one end of said shaft with the legs of said forearm-rest extending from said shaft transversely of said axis in a rearward direction, said legs being spaced from each other by a distance suitable for cradling the forearm of the user and substantially symmetrical relative to the fore-and-aft plane through said longitudinal axis in said direction, a pistol-grip handle rigidly mounted on said shaft and extending laterally therefrom generally in said rearward direction, said handle being spaced from said forearm-rest in the direction of the other end of said shaft and inclined toward said forearm-rest at an angle to said shaft, such that when it is gripped by the hand of the user with the thumb adjacent said shaft and in a natural attitude with respect to the forearm, said longitudinal axis of said shaft is disposed substantially parallel to the forearm, said forearm-rest being adapted and arranged to supportingly engage the forearm of the user when his hand is in said natural attitude and to be moved free of said forearm upon bending the wrist in a direction in which the little finger of the hand is nearer the wrist, and an ice-pick member mounted on said pistol-grip handle for movement between a sheathed position within said handle and an exposed position rearward of said handle for cooperation with said handle and said forearm-rest in braking and stopping the user on a steep incline.

3. A ski-pole or crutch comprising an elongated shaft defining a longitudinal axis, a U-shaped forearm-rest or yoke rigidly mounted adjacent one end of said shaft with the legs of said forearm-rest extending from said shaft transversely of said axis in a rearward direction, said legs being spaced from each other by a distance suitable for cradling the forearm of the user and substantially symmetrical relative to the fore-and-aft plane through said longitudinal axis in said direction, and a pistol-grip handle rigidly mounted on said shaft and extending laterally therefrom generally in said rearward direction, said handle being spaced from said forearm-rest in the direction of the other end of said shaft and inclined toward said forearm-rest at an angle to said shaft, such that when it is gripped by the hand of the user with the thumb adjacent said shaft and in a natural attitude with respect to the forearm, said longitudinal axis of said shaft is disposed substantially parallel to the forearm, said forearm-rest being adapted and arranged to supportingly engage the forearm of the user when his hand is in said natural attitude and to be moved free of said forearm upon bending the wrist in a direction in which the little finger of the hand is nearer the wrist wherein a portion of said shaft comprises the barrel and receiver of a gun with the receiver disposed adjacent said one end of said shaft and the barrel pointing toward the other end, said pistol-grip handle being mounted on said receiver for operating the gun when skiing.

* * * * *